United States Patent [19]

Eckrodt

[11] Patent Number: 4,495,785

[45] Date of Patent: Jan. 29, 1985

[54] APPARATUS FOR WET TREATMENT OF ENDLESS TEXTILE MATERIAL

[75] Inventor: Gunter Eckrodt, Coesfeld, Fed. Rep. of Germany

[73] Assignee: Thies GmbH & Co., Fed. Rep. of Germany

[21] Appl. No.: 500,953

[22] Filed: Jun. 3, 1983

[30] Foreign Application Priority Data

Jun. 3, 1982 [DE] Fed. Rep. of Germany ..... 3220990

[51] Int. Cl.[3] ..... D06B 1/04; D06B 3/16; D06B 23/04

[52] U.S. Cl. ..... 68/62; 68/158; 68/177; 68/200

[58] Field of Search ..... 68/62, 148, 158, 177, 68/178, 200, 58

[56] References Cited

U.S. PATENT DOCUMENTS

| | | | |
|---|---|---|---|
| 1,539,824 | 6/1925 | Barker | 68/148 |
| 2,548,070 | 1/1952 | Walker | 68/58 |
| 2,764,009 | 9/1956 | Sarti | 68/177 X |
| 3,037,370 | 6/1962 | Rezzonico | 68/177 X |
| 3,626,449 | 12/1971 | Komatsu-shi | 68/177 X |
| 3,949,443 | 4/1976 | Edgar | 68/58 X |

FOREIGN PATENT DOCUMENTS

| | | | |
|---|---|---|---|
| 37386 | 4/1968 | Japan | 68/177 |
| 338270 | 10/1891 | U.S.S.R. | 68/158 |

*Primary Examiner*—Philip R. Coe
*Assistant Examiner*—Frankie L. Stinson
*Attorney, Agent, or Firm*—Roylance, Abrams, Berdo & Goodman

[57] ABSTRACT

A method and apparatus for the wet treatment of endless textile material wherein the treatment liquor is scooped up by ladles or dippers disposed on a drum rotatably mounted within a boiler, the dippers carrying the treatment liquor in the drum rotation while, at the same time, the textile material rests on the outside wall of the drum and is carried along. The treatment liquor emerges from the dippers, wets and penetrates the textile material for its intensive wet treatment. The textile material and treatment liquor return to the lower area of the boiler where they are again taken up for renewed similar treatment.

12 Claims, 2 Drawing Figures

APPARATUS FOR WET TREATMENT OF ENDLESS TEXTILE MATERIAL

BACKGROUND OF THE INVENTION

Figure 1:
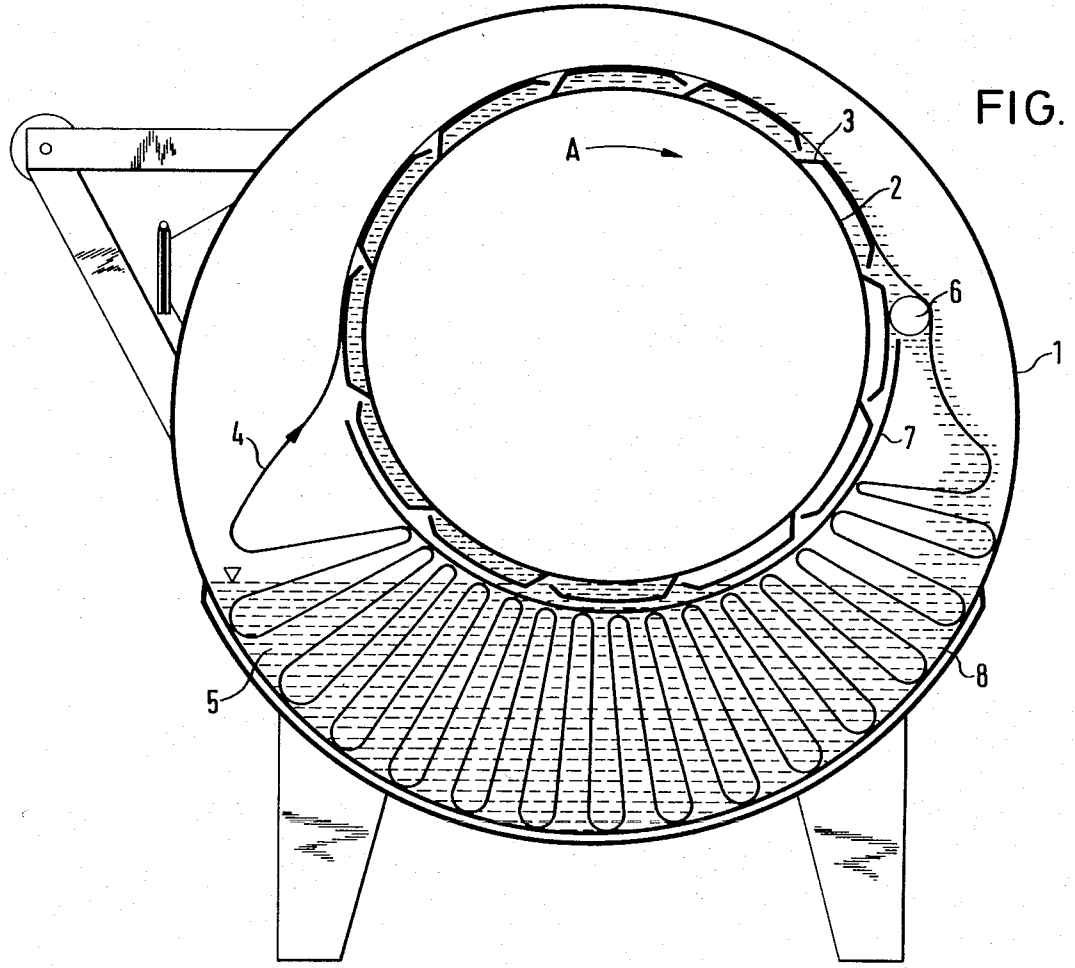

Methods and apparatus for wet-treating textile materials in an endless form are known, an example thereof being in German Pat. No. 24 27415 which shows an apparatus in which a drum is concentrically disposed within a kettle or boiler, the drum being made with permeable walls to permit passage therethrough of the treatment liquor. As a rule, at least the drum consists of upper and lower halves which are axially offset, thereby leaving a gap at one end through which the textile material can be introduced into the inside of the drum by means of a flushing-in arrangement which would normally be a conduit with a nozzle though which the textile can be introduced into the drum, conveyed by liquid. The wet treatment is accomplished during the flushing in, after which the textile material is plaited down in the inside of the drum, fitting against the inside of the wall, and is conducted further in this plaited-down form because of the rotation of the drum until it finally reaches a receiving area below a winch. The winch picks up the plaited-down textile material from the inside of the drum and guides it again along a path to the flushing-in conduit. The treatment liquor fed in by way of the flushing-in arrangement passes through perforations and the gap of the drum, is collected at the bottom area of the boiler, and is fed by means of a return arrangement again to the flushing-in arrangement.

The wet treatment of the textile material is accomplished by means of this known apparatus, and of the related process, exclusively while being guided through the flushing-in arrangement in which the textile material comes into intimate contact with the treatment liquor. As will be recognized, we are dealing here with a relatively short treatment stretch and in addition a system in which the material is exposed to a significant amount of tension as a result of its own weight during the phase of being picked up again by means of the winch.

BRIEF SUMMARY OF THE INVENTION

Accordingly, an object of the present invention is to provide an apparatus for the wet treatment of an endless segment of fabric which maintains the conditions of short liquor treatment but in addition provides an extended, intensive treatment of the textile material by extending the treatment course and, in addition, exposing the textile material to substantially no tensile load.

Briefly described, the invention includes a method for the wet treatment of textile material in an endless form in an apparatus of the type including a container and a rotatably driven drum in the container comprising providing a reservoir of treatment liquid in the bottom of the chamber, depositing a portion of the textile material across the outside of the drum to be carried along by the drum while continuously returning material to the bottom of the container at the downwardly moving side of the drum and continuously taking on material at the upwardly moving side, providing scoops in the drum to receive and carry treatment liquid to the upper portion of the drum, and releasing the treatment liquid from the scoops onto the textile during the downward movement thereof while the textile receiving the liquid is still resting on the drum surface whereby the textile thus intensively wetted and treated is returned to the bottom of the container in which it is plaited down, traverses the bottom through the reservoir of liquid and is again taken up by the drum for repeated treatment.

In another aspect, the invention comprises an apparatus for wet-treating an endless segment of textile material comprising a closed, generally cylindrical container; a drum rotatably mounted in said container with the bottom of said drum spaced from the bottom of said container; means for rotating said drum in one direction; means carried by said drum forming a plurality of dippers each having a tangentially directed opening facing in the direction of rotation such that liquid therein empties from each dipper as it passes the apogee of drum rotation; and means for filling said dippers with treatment liquid as they rotate with said drum through the lowest point thereof, whereby an endless segment of textile placed over said drum is repeatedly treated with liquid emptying onto the surface closest to said drum.

As a result of the improvements in accordance with the invention, it is possible to achieve in an advantageous manner, close contact of the textile material with the treatment liquor for approximately one-quarter of the periphery of the drum, namely along that quarter of the periphery starting out from the top most portion of the drum at which the treatment liquor emerges from the ladle means and, at the same time, passes right through the textile material.

On the other hand, on the opposite side of the drum, the plaited-down textile material is received by the drum in a way that there is hardly any lifting of it since the textile material is lifted approximately from half the height of the drum and is available in a plaited-down form almost up to this height. Insofar as the textile material still lies in the the treatment liquor in the plaited-down form in the inside of the boiler, this does not serve for the actual wet treatment. A side effect of this "floating" storage is merely the fact that the textile material will more easily slide along the inside wall of the boiler. Maintaining short liquor conditions is guaranteed easily because of the fact that, in the actual treatment appartus, only so much treatment liquor is to be contained that it can be ladled out by means of the ladling devices of the drum.

Figure 2:
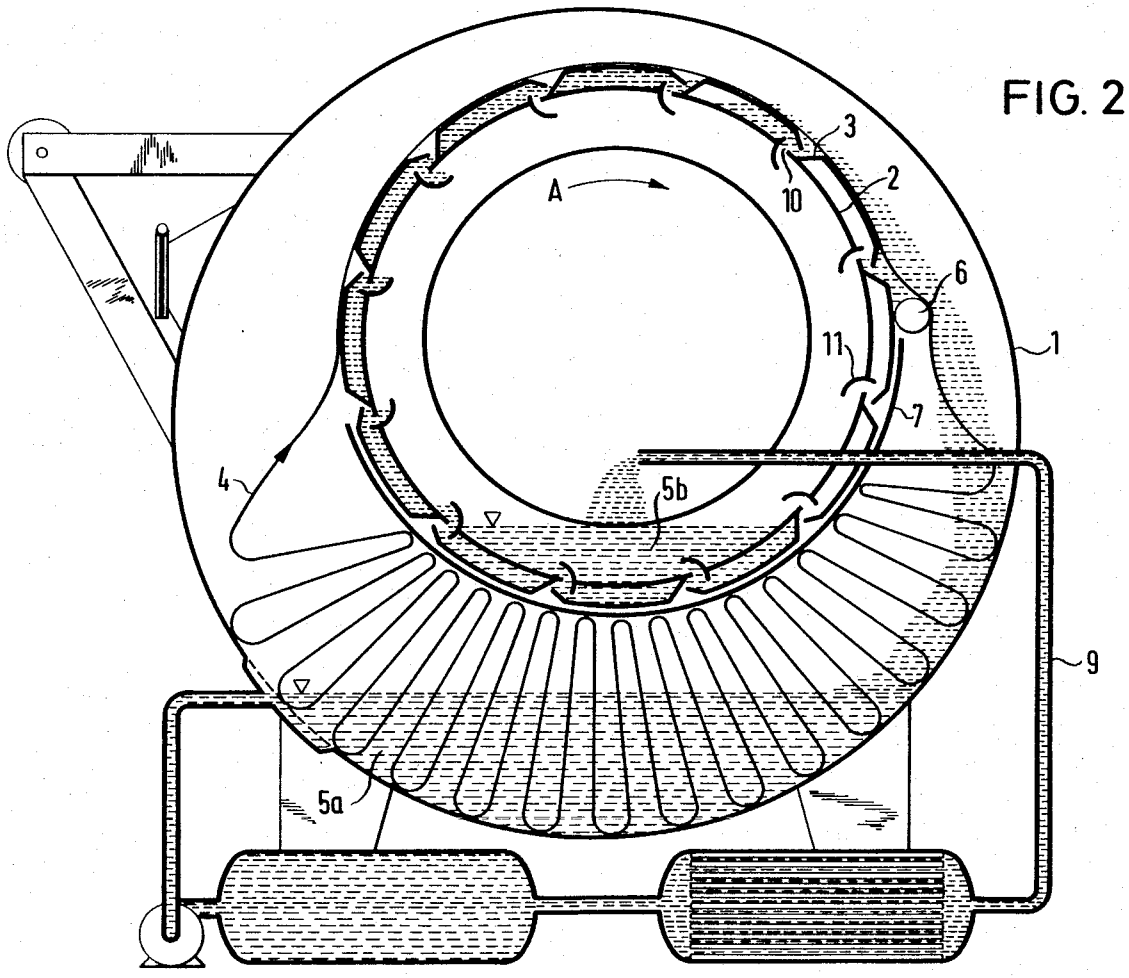

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a schematic end elevation, in section, of a first embodiment of an apparatus in accordance with the invention; and FIG. 2 is a similar view of a second embodiment of an apparatus in accordance with the invention.

Referring now to the drawings in detail, it will be seen that the primary components of the apparatus in accordance with the invention are a closed cylindrical container which can be a kettle or boiler 1 and a drum 2 rotatably mounted within the container and having ladles or dippers 3 mounted on the drum. Preferably, the drum is motor driven. In the embodiments of both FIGS. 1 and 2, it will be observed that the drum is mounted eccentrically with respect to the kettle 1, the axis of rotation of the drum being significantly higher than the central longitudinal axis of the kettle in order to provide sufficient space below the drum for the reception of plaited-down textile material 4.

In the embodiment of FIG. 1, the drum 2 is formed as a closed cylinder with ladle means or dippers 3 mounted on the outside thereof. The drum 2 is rotated in the direction indicated by arrow A. The dippers are formed with closed ends and a generally tangentially directed open side, opening toward the direction of rotation, so that, in the indicated direction of rotation, the dippers scoop up the liquid when they are at the lowest point of their circular travel with the drum, the liquor being scooped up from the reservoir of liquid 5 forming a treatment liquor sump in the lower area of the inside of kettle 1. The picked-up treatment liquor is carried along by dipper 3 as the drum rotates, the liquor only being allowed to escape from the dippers as they reach and pass the uppermost extent of travel of drum 2.

As illustrated in FIG. 1, the textile material 4 will be received by the drum at a point which is about half the height of the drum and is placed upon the exterior surface of the drum and is carried along during its rotation. Considering one portion of the yarn as it rests on and rotates with the drum, as soon as that portion passes the highest point of the drum rotation, treatment liquor emerging from one of the dippers 3 which lies immediately behind that portion of the textile, rotationally speaking, and the liquor emerging from that dipper flows to the side of the textile which is adjacent the drum and then flows through the textile material and along both sides of the material downwardly in the direction toward the reservoir or sump 5. Approximately opposite the receiving area of drum 2 as it takes up textile material 4, a take off arrangement including a roller 6 is provided, the roller being positioned to be adjacent the drum and to allow the textile material to roll across the roller, permitting it to plait down freely in approximately an accordian shape. This plaited-down textile material then continuously slides through the sump of the treatment liquor until it is finally again picked up by the rising portion of drum 2 as illustrated.

Approximately the lower half of drum 2 is provided with an arcuate, fixed baffle plate 7 which extends for substantially the entire axial length of the drum, the baffle plate being permeable to the treatment liquor so that the fluid can reach the dippers as they pass through the lowest point of rotation.

As will be recognized, it is not essential that the dippers 3 be placed on the outside of the drum 2. Rather, the dippers can be disposed within the drum such that their bases, together with the remaining areas of the actual surface of the drum 2, form an impermeable wall for the treatment liquor so that it may again be ladled up in the described manner from sump 5 and can be carried along during the rotation of the drum until it emerges from the dippers 3 after passing the apex of rotation.

It will also be recognized that supplementary arrangements for the thermal conditioning of the treatment liquor, such as pre-heaters, regulators and the like, as well as arrangements for the circulation of the treatment liquor, such as circulating pumps and the like, can be provided. There is also the possibility of direct heating of the boiler 1 as by means of a double jacket section 8 illustrated schematically in FIG. 1.

The embodiment of FIG. 2 differs from that of FIG. 1 in the fact that the treatment liquor is conveyed by means of a circulation system 9 from the sump 5*a* which is located in the lower area of the inside of the boiler into a supplemental sump 5*b* within drum 2. In order for it to be possible to feed the treatment liquor from sump 5*b* to dippers 3, there are openings 10 provided in the jacket of the drum communicating from the inside to the outside. These openings 10, viewed essentially from the inside of the drum 2, are equipped with baffle plates 11, the shaping of which guarantees that at least the major part of the treatment liquor contained in the dippers 3 is kept in the dippers during the upwardly directed portion of the rotation of drum 2 and is released only after passing the apex of rotation of the drum. For this purpose, the baffle plates 11 are bent in the direction of rotation A around the openings of passages 10.

Furthermore, in this second embodiment, the baffle plate 7 is constructed to be impermeable to the treatment liquor so that the liquid contained in sump 5*b* cannot flow downwardly to sump 5*a*.

In both of the embodiments of FIGS. 1 and 2, baffle plate 7 served for the protection of the textile material 4 in its plaited-down form against contact with drum 2.

In the embodiment of FIG. 2, it is possible to operate successfully with an even smaller quantity of treatment liquor than in the embodiment of FIG. 1. Both embodiments, as well as the process according to the invention, are generally suitable for the wet treatment of textile material in folded up form as well as a form in which it is spread out as a flat web.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for wet-treating an endless segment of textile material, comprising:

a closed, generally cylindrical container;

a drum rotatably mounted about the longitudinal axis thereof in said container with a bottom of said drum spaced from a bottom of said container;

a plurality of dippers carried by said drum, each of said dippers having a tangentially directed opening facing in the direction of drum rotation such that liquid therein empties from each dipper as each dipper passes an apogee of drum rotation;

means for filling said dippers with treatment liquid as said dippers rotate with said drum through a lowest point thereof; and means for conveying an endless segment of textile over an outer surface of said drum such that said textile is repeatedly treated with liquid emptying from said dippers onto a surface of said textile closest to said drum adjacent said apogee.

2. An apparatus according to claim 1 wherein said drum comprises a closed cylinder and said dippers are provided on the outer surface thereof.

3. An apparatus according to claim 2 wherein roller means for removing textile from the outer surface of said drum is mounted adjacent a downwardly moving side of said drum near a horizontal plane including the drum axis.

4. An apparatus according to claim 1 wherein said dippers comprise a plurality of chambers circumferentially arranged on said drum and means extending into said drum for receiving liquid from within said drum.

5. An apparatus according to claim 4 wherein roller means for removing textile from the outer surface of said drum is mounted adjacent a downwardly moving side of said drum near a horizontal plane including the drum axis.

6. An apparatus according to claim 5 wherein a baffle plate generally encompasses a lower half of said drum and conforms to the shape thereof to isolate said drum from textile material passing across the bottom of said container.

7. An apparatus according to claim 4 wherein a baffle plate generally encompasses a lower half of said drum and conforms to the shape thereof to isolate said drum from textile material passing across the bottom of said container.

8. An apparatus according to claim 4 wherein said means for filling said dippers comprises a recirculating system for returning treatment liquid to an interior of said drum; and wherein each of said means extending into said drum includes an opening through said drum and a catch plate curved to collect and hold liquid adjacent an inner side of said opening during at least most of upward movement of said dippers.

9. An apparatus according to claim 1 wherein a baffle plate generally encompasses a lower half of said drum and conforms to the shape thereof to isolate said drum from textile material passing across the bottom of said container.

10. An apparatus according to claim 9 wherein said baffle plate is permeable to the treatment liquid.

11. An apparatus according to claim 9 wherein said baffle plate is impermeable to the treatment liquid.

12. An apparatus according to claim 1 wherein roller means for removing textile from the outer surface of said drum is mounted adjacent a downwardly moving side of said drum near a horizontal plane including the drum axis.

* * * * *